US010697724B2

(12) United States Patent
Cochran et al.

(10) Patent No.: US 10,697,724 B2
(45) Date of Patent: Jun. 30, 2020

(54) BOTTOM METAL FOR A DETACHABLE BOX MAGAZINE

(71) Applicant: RedSnake Enterprises, LLC, Dallas, TX (US)

(72) Inventors: Spencer Cochran, Dallas, TX (US); Jake Porter, Dallas, TX (US)

(73) Assignee: RedSnake Enterprises, LLC, Dallas, TX (US)

( * ) Notice: Subject to any disclaimer, the term of this patent is extended or adjusted under 35 U.S.C. 154(b) by 0 days.

(21) Appl. No.: 15/980,344

(22) Filed: May 15, 2018

(65) Prior Publication Data

US 2018/0335266 A1 Nov. 22, 2018

Related U.S. Application Data

(60) Provisional application No. 62/506,985, filed on May 16, 2017.

(51) Int. Cl.

| | |
|---|---|
| ***F41A 3/66*** | (2006.01) |
| ***F41A 11/02*** | (2006.01) |
| ***F41A 19/10*** | (2006.01) |
| ***F41A 17/38*** | (2006.01) |

(52) U.S. Cl.

CPC ..... *F41A 11/02* (2013.01); *F41A 3/66* (2013.01); *F41A 17/38* (2013.01); *F41A 19/10* (2013.01)

(58) Field of Classification Search

CPC .... F41A 3/64; F41A 3/66; F41A 11/00; F41A 11/02

See application file for complete search history.

(56) References Cited

U.S. PATENT DOCUMENTS

| | | | | | |
|---|---|---|---|---|---|
| 593,835 | A | * | 11/1897 | Clausius | F41A 3/64 89/143 |
| 785,275 | A | * | 3/1905 | Schoubce | F41A 3/64 89/128 |
| 1,044,983 | A | * | 11/1912 | Brown | F41A 9/65 42/50 |
| 1,291,689 | A | * | 1/1919 | Sheppard | F41A 11/02 42/16 |
| RE15,801 | E | * | 3/1924 | Rychiger | F41A 3/26 42/16 |
| 1,603,684 | A | * | 10/1926 | Garand | F41A 3/26 42/75.01 |
| 1,844,779 | A | * | 2/1932 | Messenie | F41A 9/28 42/59 |
| 1,907,164 | A | * | 5/1933 | White | F41A 3/32 42/16 |

(Continued)

FOREIGN PATENT DOCUMENTS

EP 3124910 A1 2/2017

*Primary Examiner* — Derrick R Morgan

(57) ABSTRACT

A rifle comprises a receiver, a trigger assembly operably coupled to the receiver, and a bottom metal coupled to the receiver. The bottom metal comprises a magazine well comprising a magazine well sidewall, and a front surface of a rear portion of the magazine well sidewall is aligned at or near a front surface of the trigger assembly. The rear portion of the magazine well sidewall can be disposed below the trigger assembly, and the front surface of the rear portion of the magazine well sidewall can be aligned with or behind the front surface of the trigger assembly.

13 Claims, 7 Drawing Sheets

(56) References Cited

U.S. PATENT DOCUMENTS 2,035,539 A * 3/1936 Dicke ..... F41A 3/26 42/16
2,109,578 A * 3/1938 Reising ..... F41A 3/66 42/16
2,370,233 A * 2/1945 Crockett ..... F41A 5/18 42/75.01
2,765,563 A * 10/1956 Roper ..... F41C 7/00 42/69.01
2,875,544 A * 3/1959 Krieger ..... F41A 9/59 42/18
2,912,781 A * 11/1959 Lizza ..... F41A 11/00 42/69.01
2,926,445 A * 3/1960 Green ..... F41A 3/66 42/17
2,975,540 A * 3/1961 Lewis ..... F41A 3/66 42/16
2,997,803 A * 8/1961 Florence ..... F41A 9/70 42/18
3,013,355 A * 12/1961 Weatherby ..... F41A 3/22 42/16
3,092,924 A * 6/1963 Seecamp ..... F41A 3/72 42/22
3,287,842 A * 11/1966 Denhoff ..... F41A 3/66 42/16
3,362,095 A * 1/1968 Byer ..... F41A 11/02 42/106
3,977,297 A * 8/1976 Orozco ..... F41A 3/64 89/199
4,012,859 A * 3/1977 Johansson ..... F41A 3/66 42/75.03
4,048,901 A * 9/1977 Ghisoni ..... F41A 3/64 89/132
4,056,038 A * 11/1977 Rath ..... F41A 5/18 89/128
4,237,638 A * 12/1980 Trexler ..... F41A 9/64 42/6
4,312,146 A * 1/1982 Koon, Jr. ..... F41C 23/00 42/75.03
4,531,446 A * 7/1985 VanVoorhees ..... F41A 11/02 89/145
4,697,495 A * 10/1987 Beretta ..... F41A 11/00 89/142
5,899,013 A * 5/1999 Hauser ..... F41A 17/38 42/6
7,726,060 B1 * 6/2010 Jones ..... F41A 3/66 42/75.02
7,735,409 B1 * 6/2010 Tertin ..... F41A 3/72 42/69.02
7,905,041 B1 * 3/2011 Davies ..... F41A 3/66 42/75.02
D640,766 S * 6/2011 Joplin ..... D22/108
7,963,062 B1 * 6/2011 Rotharmel ..... F41A 9/25 42/69.01
8,307,575 B1 * 11/2012 Battaglia ..... F41A 3/64 42/75.03
8,434,253 B2 * 5/2013 Cain ..... F41A 17/38 42/49.01
9,618,285 B2 * 4/2017 Leimer ..... F41A 9/64
9,689,632 B2 * 6/2017 Hawkins ..... F41A 3/66
9,766,029 B2 * 9/2017 Dextraze ..... F41A 29/00
10,101,102 B2 * 10/2018 Eitan ..... F41A 11/02
2003/0167672 A1 * 9/2003 Makindretos ..... F41A 9/18 42/17
2008/0060247 A1 * 3/2008 Thomele ..... F41A 3/66 42/71.02
2010/0162605 A1 * 7/2010 Laney ..... F41A 3/24 42/25
2011/0094139 A1 * 4/2011 Atzl ..... F41A 19/12 42/69.01
2011/0099874 A1 * 5/2011 Zedrosser ..... F41A 3/66 42/73
2011/0154709 A1 * 6/2011 Rotharmel ..... F41A 9/25 42/69.01
2012/0085009 A1 * 4/2012 Crow ..... F41A 3/66 42/6
2012/0137556 A1 * 6/2012 Laney ..... F41A 11/02 42/6
2012/0180360 A1 * 7/2012 Jones ..... F41A 11/02 42/75.03
2014/0165440 A1 * 6/2014 Mayerl ..... F41A 9/55 42/6
2014/0230297 A1 * 8/2014 Larson, Jr. ..... F41A 17/38 42/6
2014/0237878 A1 * 8/2014 Lambert ..... F41A 3/66 42/75.01
2014/0317983 A1 * 10/2014 Bush ..... F42B 5/32 42/17
2015/0192384 A1 * 7/2015 Ballard ..... F41A 9/70 42/49.01
2015/0267988 A1 * 9/2015 Sellars ..... F41A 21/485 42/75.02
2015/0316335 A1 * 11/2015 Withey ..... F41A 3/22 42/16
2015/0377575 A1 * 12/2015 Potter ..... F41A 17/52 42/69.01
2016/0076840 A1 * 3/2016 Leimer ..... F41A 9/64 42/50
2016/0076850 A1 * 3/2016 Sullivan ..... F41A 9/71 124/63
2016/0187087 A1 * 6/2016 Olsen ..... F41A 3/66 42/75.03
2016/0187092 A1 * 6/2016 Mather ..... F41A 19/10 42/69.02
2016/0252314 A1 * 9/2016 Mather ..... F41A 3/22 42/16
2016/0298918 A1 * 10/2016 Baker ..... F41A 9/65
2017/0030667 A1 * 2/2017 Eitan ..... F41A 11/02
2018/0003457 A1 * 1/2018 McCallum ..... F41A 19/10
2018/0094891 A1 * 4/2018 Geissele ..... F41A 17/46
2018/0335266 A1 * 11/2018 Cochran ..... F41A 11/02
2019/0041164 A1 * 2/2019 Hughes ..... F41G 3/2655
2019/0154368 A1 * 5/2019 Kim ..... F41A 11/02
2019/0316864 A1 * 10/2019 Shane ..... F41A 21/36

* cited by examiner

BOTTOM METAL FOR A DETACHABLE BOX MAGAZINE

CROSS-REFERENCE TO RELATED APPLICATIONS

This application claims priority to U.S. Provisional Patent Application No. 62/506,985 filed on May 16, 2017 and entitled "Bottom Metal for Detachable Box Magazine," which is incorporated herein by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Bolt action type rifles are typically considered to be one of the most accurate types of rifles. These rifles can include a non-removable box magazine or a removable magazine. In general, the original magazine supplied by the manufacturer and even available aftermarket magazines have certain limitations, including limitations on the overall length of the cartridges that can fit within the magazine.

SUMMARY

In an embodiment, a rifle comprises a receiver, a trigger assembly operably coupled to the receiver, and a bottom metal. The bottom metal comprises a magazine well comprising a magazine well sidewall, and a front surface of a rear portion of the magazine well sidewall is aligned at or near a front surface of the trigger assembly.

In an embodiment, a bottom metal component comprises: a bottom metal base comprising a trigger opening and a magazine well opening, a trigger guard extending in a first direction from the bottom metal base, and a magazine well sidewall extending in a second direction from the bottom metal base wherein the trigger opening is disposed above the trigger guard. The magazine well opening is disposed below the magazine well sidewall, and the magazine well sidewall is configured to be disposed below a trigger assembly when assembled in a rifle.

A bottom metal component comprises a bottom metal base comprising a trigger opening and a magazine well opening, a trigger guard extending in a first direction from the bottom metal base, and a magazine well sidewall extending in a second direction from the bottom metal base. The trigger opening is disposed above the trigger guard, and the magazine well opening is disposed below the magazine well sidewall. An interior surface of a rear magazine side wall is aligned with at least a portion of the trigger guard.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
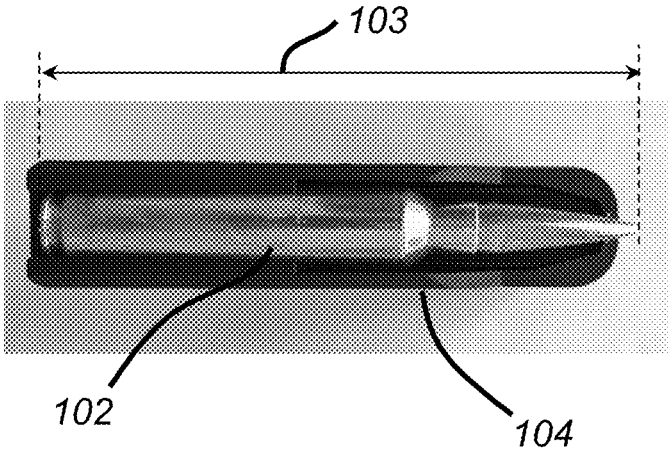
FIGS. 1A-1B are top views of a cartridge in a magazine according to an embodiment.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

As used herein, the terms "front" or "forward" refer to a direction towards the end of the barrel on a rifle, while the terms "rear," "back," or "rearward" refer to a direction or position towards the butt pad on the rifle. The terms "upwards," "up," or "top" refers to a direction towards the receiver from the trigger guard, and the terms "downwards," "down," or "bottom" refers to a direction from the receiver towards the trigger guard.

The original magazine supplied by the manufacturer with some bolt action rifles has certain limitations, including limitations on the overall length of the cartridges that can be used in the magazine. Even when magazines allow cartridges with an increased overall length to fit within them, the alignment of the magazine within the action can preclude feeding of the cartridge or limit the reliability of the feeding of the cartridge into the rifle's action. In order to overcome these limits, some users convert bolt action types into a rifle suitable for use with a detachable box magazine. The removable box magazine can have longer dimensions to provide a greater overall cartridge length. However, due to certain tolerances, alignment of the magazine with the action, and other spacing concerns, even replacement box magazines and the corresponding bottom metal replacements still limit the available cartridge length.

The accuracy of a bolt action rifle can be affected by the overall cartridge length. For some rifles, improved bolt action rifle cartridge performance can be limited by short Overall Cartridge Length (OAL) as specified by Sporting Arms and Ammunition Manufacturer's Institute Inc. (SAAMI) standards. Handloaders and custom ammunition manufactures typically load cartridges longer than SAAMI specifications. SAAMI is part of the American National Standards Institute, Inc. (ANSI) and is the governing body of the firearms/ammunition industry that publishes standards related to ammunition and chamber specifications. Thus, the ability to currently use box magazines that can accommodate longer OAL cartridges would be desirable.

As an example, factory/OEM ammunition magazines for Tikka T3/T3x rifles are too short to hold cartridges beyond SAAMI specifications. As example is shown in FIG. 1A in which a cartridge 102 is positioned within a factory magazine 104. The cartridge 102 comprises loaded ammunition including a case holding the powder and a bullet seated into the mouth of the case. As shown the cartridge 102 has a length 103 resulting in the bullet tip extending outside of the overall length of the magazine 104. The overall length 103 of an ammunition cartridge is a measurement from the base of the brass shell casing to the tip of the bullet, seated into the brass casing. A cartridge's overall length 103 may be shorter than the maximum standard (SAAMI), equal to the standard, or longer than standard. When the length 103 of the cartridge 102 is longer than the length of the magazine 104, the magazine may be prevented from being inserted into the magazine well in the bottom metal of the rifle.

Figure 1B:
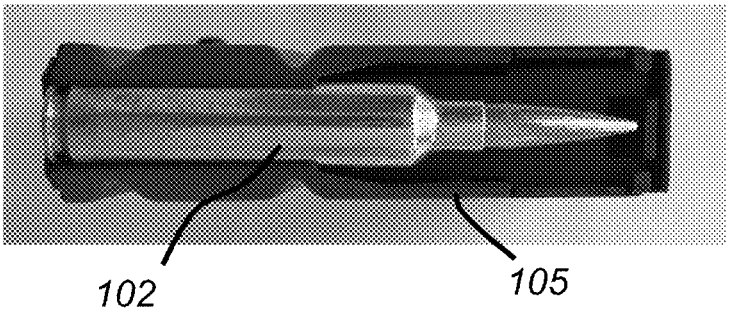

Available aftermarket magazines allow for longer OAL in some instances, but due to internal constraints of the action (limited length of the opening on the bottom of the Tikka action and similarly for a Remington model 700 action), alignment of the magazine with the action, and design limitations of current compatible aftermarket bottom metal components, ammunition with optimal OAL will not feed the Tikka T3/T3x. For example, FIG. 1B shows the cartridge 102 within a longer magazine 105. However, the magazine dimensions are not suitable for use with the bottom metal of the rifle. While the Tikka rifles are disclosed as examples, other manufacturer designs suffer similar issues. For example, a Remington model 700 action (and all customer actions patterned after the Remington Model 700) also has design limitations in the manufacturer's bottom metal design that can prevent longer OAL in some instances. Other manufacturers also have similar limitations.

Disclosed herein is a new aftermarket bottom metal for short and/or long action rifles that is configured to accept aftermarket magazines that allows for longer cartridges OAL and improved cartridge feeding. When configured within the bolt action rifle, the bottom metal can position the magazine such that the magazine is moved towards the trigger assembly. This position may allow for the trigger guard and/or the trigger assembly to serve to stabilize the magazine while also allowing for use of cartridges with an improved OAL.

Figure 2:
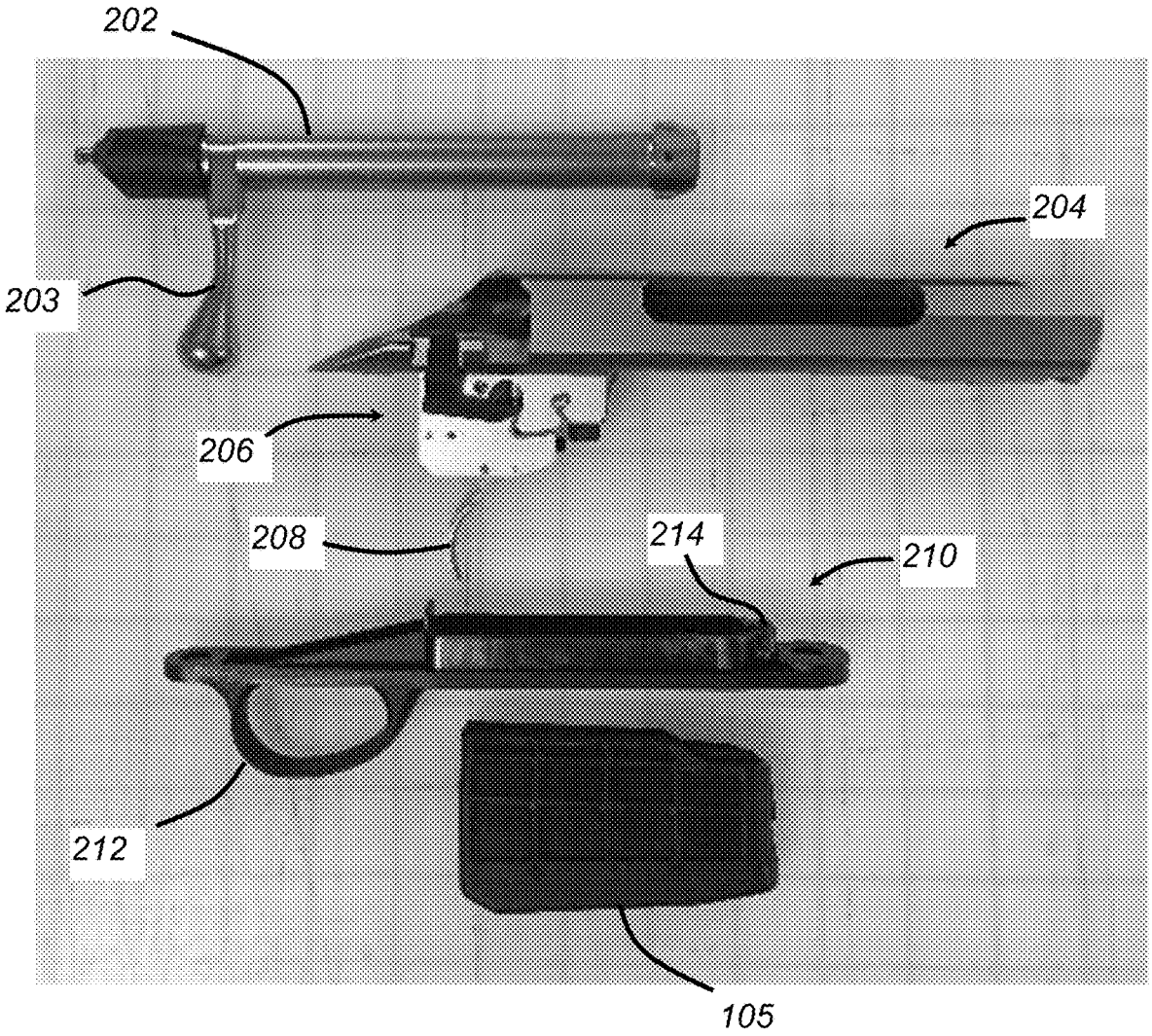
FIG. 2 illustrates the components of a firearm according to embodiments of the disclosure.

FIG. 2 illustrates an exploded view of a number of components of an exemplary bolt action rifle having an action. The action is the part of the rifle that loads, fires, and ejects a cartridge. In general, a bolt action rifle is a type of firearm action in which a sliding bolt 202 is operated manually via a handle 203 affixed to the bolt 202 to load a single ammunition cartridge into the barrel, which would be attached to the forward portion of the receiver 204. The receiver 204 is the part of the firearm frame which provides a housing for the bolt 202 and firing mechanism, into which ammunition is fed via a magazine 105. The trigger assembly 206 comprises a trigger 208 mechanically coupled to a firing mechanism configured to actuate a firing pin upon movement of the trigger 208. In some embodiments, a safety mechanism can also be incorporated into the trigger assembly 206 to allow the firearm to be placed in a safe mode in which the trigger and/or firing pin are rendered inoperable, and a fire mode in which movement of the trigger actuates the firing pin.

Cartridges can be fed into the receiver 204 from below via an internal/integrated magazine or a detachable box magazine 105. The bottom metal 210 is a removable part of the firearm on the bottom of the bolt action rifle comprising of a trigger guard 212 and magazine well 214 that connects the stock to the action and houses the gun's magazine 105 that feeds the cartridge into the receiver 204. The magazine 105 serves as an ammunition storage and feeding device within or attached to a repeating firearm. Magazines can be removable (detachable) or integral to the firearm. As shown in FIG. 2, the magazine 105 can be removable and fit within the magazine well 214. The magazine well 214 is an opening in the bottom metal 210 where the magazine 105 fits and is retained (e.g., by a magazine release as described in more detail below) during use while engaging a receiver slot in the lower portion of the receiver 204.

Figure 3:
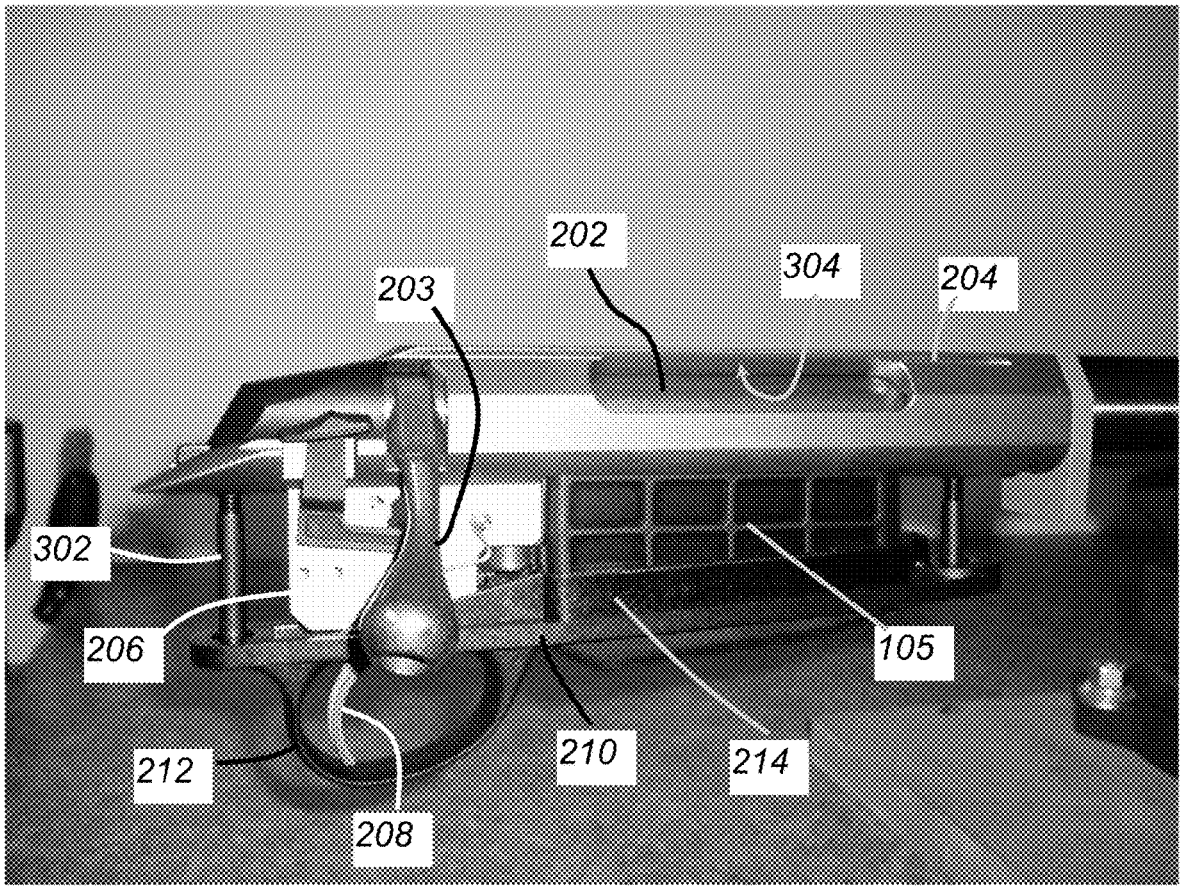
FIG. 3 illustrates the components of a firearm in an assembled view according to embodiments of the disclosure.
Figure 4:
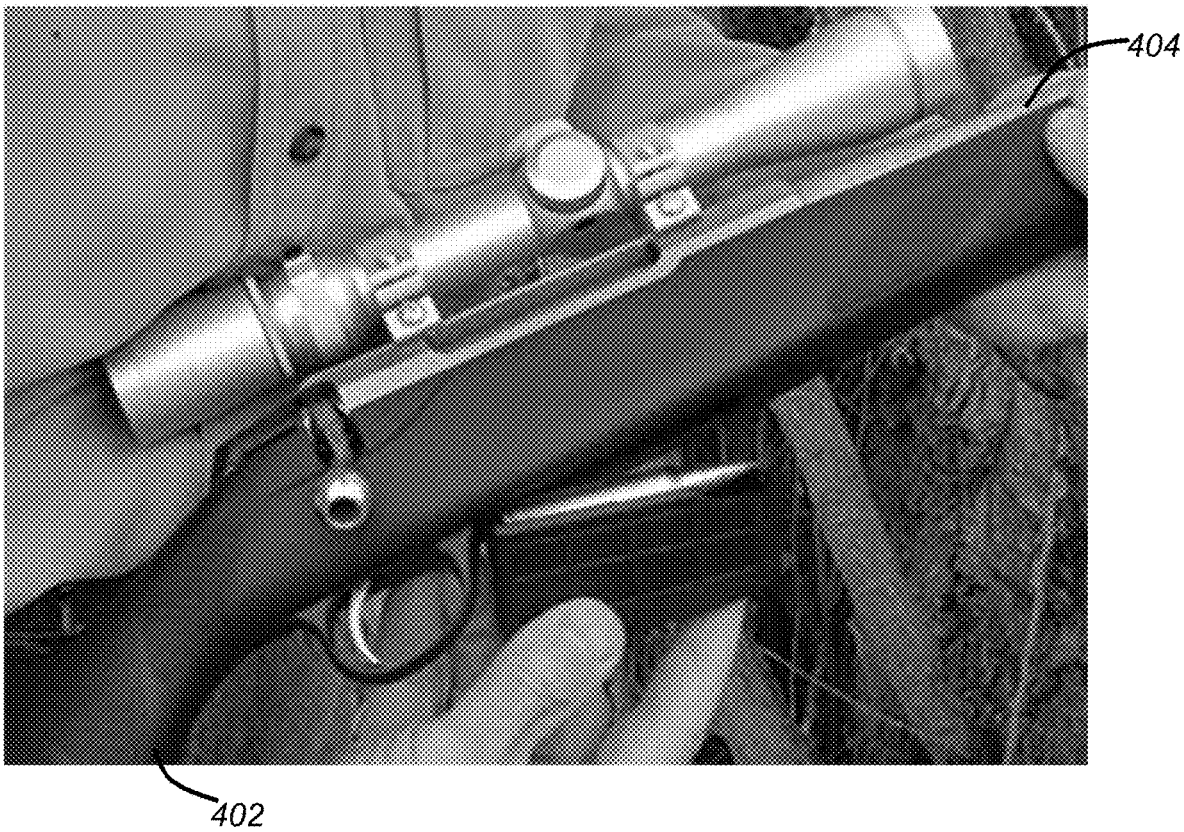
FIG. 4 illustrates the components of a firearm in another assembled view according to embodiments of the disclosure.

FIGS. 3 and 4 illustrate a perspective view of the rifle assembled without the stock and with the stock in place, respectively. As shown, the bolt 202 is disposed within the receiver 204 and mechanically coupled to the trigger assembly 206. The bottom metal 210 is mechanically coupled to the receiver 204 using a pair of bolts or screws 302. The trigger 208 extends through an opening in the bottom metal 210 and is disposed within the trigger guard 212. The alignment of the bottom metal 210 and the receiver 204 is such that the magazine well 214 aligns the magazine with the opening in the lower portion of the receiver 204 to allow the cartridge to be fed into the receiver and chamber.

FIG. 4 illustrates the rifle with the stock 402 and barrel 404 in place. The bottom metal 210 can be seen to fit within a recess in the lower portion of the stock 402, and the stock 402 encloses the trigger assembly 206, the magazine well 214, and the lower portion of the receiver 204. The magazine well 214 opening is accessible from the bottom of the bottom metal 210 to allow the magazine 105 to be inserted into the rifle while being enclosed within the stock 402.

With reference to FIGS. 2-4, a user can load one or more cartridges into the magazine 105 and place the magazine into the magazine well 214 through the opening in the lower side of the bottom metal 210 in use. As the magazine 105 is placed into the magazine well 214, the top portion of the magazine 105 can engage the lower side of the receiver 204. At about this position, a magazine release can engage a protrusion, recess, or other feature on an exterior surface of the magazine to retain the magazine within the magazine well. The magazine release can be spring loaded so that the magazine release is biased into engagement with the magazine during use to retain the magazine within the magazine well 214 until released. With the magazine inserted, a cartridge retained by the magazine 105 can be positioned within the opening in the lower side of the receiver 204. In general, the magazine is configured to provide a bias force to the cartridge(s) so that the cartridge(s) moves upwards within the magazine while the top most cartridge is retained in position at the top of the magazine 105.

When the bolt is opened (e.g., by rotating the handle and pulling to partially retract the bolt 202 from the receiver 204), the cartridge at the top of the magazine 105 can move upwards slightly into the opening within the receiver 204. When the bolt 202 is closed into the receiver 204, the bolt can catch at least a portion of the cartridge and slide the cartridge out of the magazine 105 and into the chamber in the receiver 204. When the bolt 202 is closed (e.g., by fully inserting the bolt 202 into the receiver 204 and rotating the handle 203 closed), it can lock the bolt 202 into place behind the cartridge. In some embodiments, the action of closing the bolt 202 can cock the firing pin so that the rifle is ready to fire when the trigger 208 is pulled. When the rifle is in the firing mode, a resulting trigger 208 pull would actuate the firing mechanism to release or move the firing pin, striking the cartridge in the primer to fire the bullet from the barrel. Once fired, a further cycling of the bolt 202 can result in the remaining spent casing being extracted and ejected out the ejection port 304 prior to the next cartridge in the magazine 105 (if present) being loaded into position when the bolt 202 is reinserted.

As noted above, the magazine 105 can be inserted into the magazine well 214 opening in the lower portion of the bottom metal 210. The relative alignment of the bottom metal with respect to the receiver 204 results in the overall alignment of the magazine well 214 with respect to both the trigger assembly 206 and the opening in the receiver 204. Factory bottom metal provided with most rifles positions the magazine well (and therefore the resulting magazine when inserted) forward of the trigger assembly 206. The length of the opening in the receiver 204 for receiving a cartridge is set upon manufacturing and cannot be modified without significant cost or replacing the receiver 204. As a result, distance between the rear end of the magazine and the front of the opening in the receiver 204 sets the maximum cartridge length that can be used (e.g., therefore limiting the OAL available). The placement of the magazine well and resulting magazine placement also leaves a gap between the rear surface of the magazine 105 in the magazine well 214 and the front surface of the trigger assembly 206. This placement also leaves a gap between the rear surface of the magazine 105 extending below the bottom metal and the front surface of the trigger guard 212. Even aftermarket bottom metal designs position the magazine well forward of the trigger assembly and leave a gap between the magazine and the trigger guard 212 and/or the trigger assembly 206, which limits the OAL available.

As described herein, the bottom metal 210 is arranged and installed in a position that positions the magazine well 214 near the trigger assembly 206 such that the gap between the front of the trigger assembly 206 and the rear surface of the magazine 105 is reduced. In some instances, the front surface of the trigger assembly 206 serves as an engagement surface for the magazine 105 in addition to the walls of the magazine well 214. This serves to stabilize the magazine 105 when installed as well as allowing for a longer OAL for the cartridges used in the rifle.

FIGS. 5A-5E illustrate various views of a bottom metal 210 according to an embodiment. As shown the bottom metal 210 comprises a trigger guard 212 disposed below a trigger opening 503 and a magazine well 214 as described above. A magazine release 502 can be posited forward of the trigger guard 212. The magazine release 502 can be coupled to the bottom metal 210 by a pin 504 while being biased into an engaged position by a spring positioned between the top of the magazine release above the pin 504 and the trigger guard 212. Grooves or other engagement features can be placed in the magazine release 502 to provide a contact surface for pressing the magazine release 502 to release the magazine 105 from the magazine well 214 in the bottom metal 210.

Figure 5A:
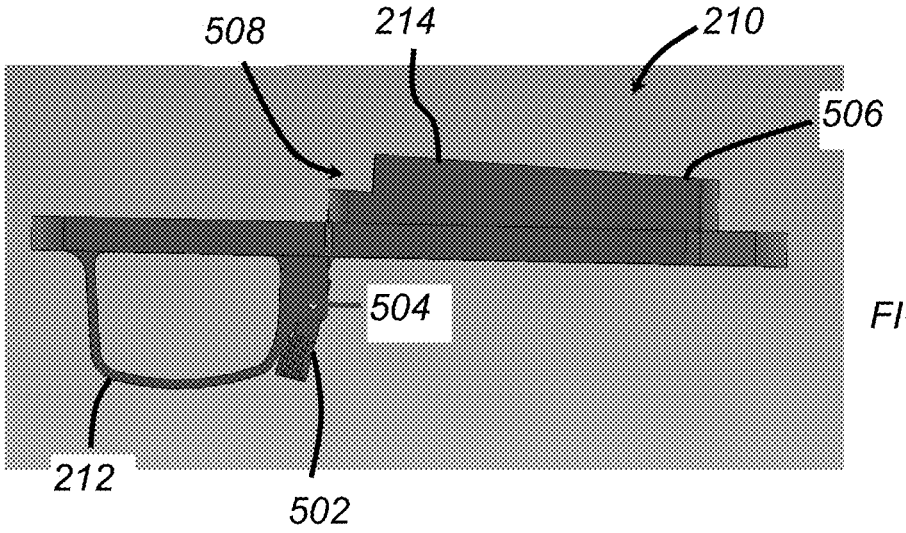
FIGS. 5A-E illustrate various views of a bottom metal according to embodiments of the disclosure.
Figure 5B:
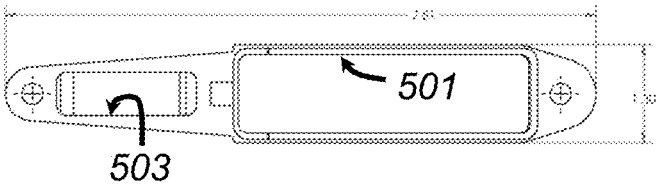
Figure 5E:
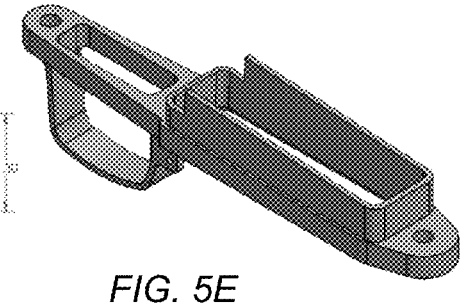
Figure 5C:
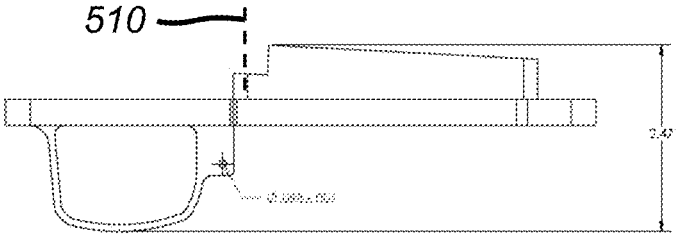
Figure 5D:
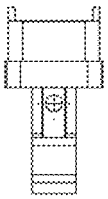
Figure 6:
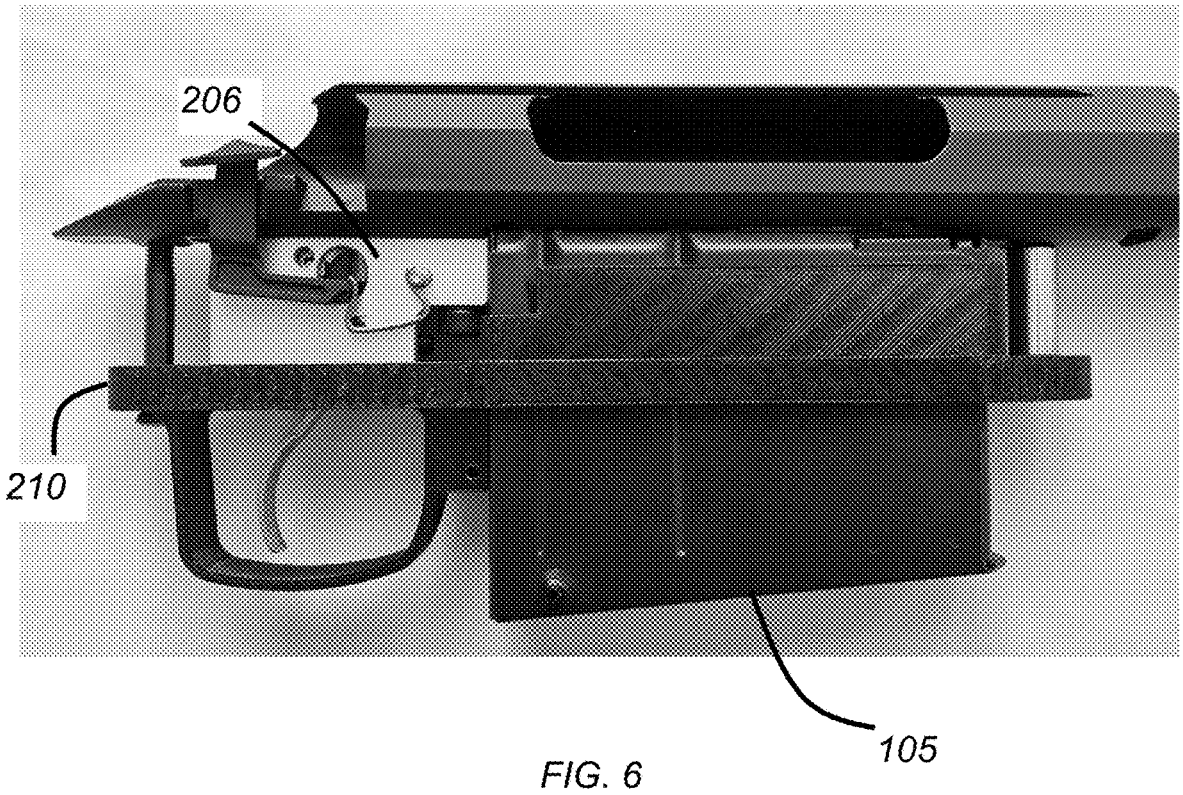
FIG. 6 illustrates an assembled side view of a bottom metal with a magazine disposed therein according to an embodiment of the disclosure.

The bottom metal 210 also comprises a magazine well 214 having a plurality of sidewalls 506 extending upwards towards the receiver. The upwards extending sidewalls 506 surround and define the magazine well opening 501 that is configured to receive the magazine 105. The interior surface of the magazine well 214 serves to engage and support the magazine while it is inserted and retained in position within the rifle. The magazine well sidewalls 506 can comprise a straight or sloped upper edge. As shown in FIG. 5A, the upper edge of the magazine well sidewalls 506 can be sloped from front to back, though when placed in a given rifle, a sloped edge may assume a level configuration due to a sloped configuration of the bottom metal relative to the stock and the remaining components of the action. A notch or other cutout 508 can be formed at the rear end of the magazine well 214. The cutout 508 can serve to allow the rear end of the magazine well sidewalls to be placed below the trigger assembly. The cutout 508 may be optional when a height of the magazine well sidewalls 508 is sufficiently low to allow the sidewalls to clear the trigger assembly in a particular rifle.

The ability of the magazine well sidewalls 508 to be placed below the trigger assembly may allow the interior surface of the rear wall of the magazine well 214 to be aligned with or aligned behind the front surface of the trigger assembly. As shown in FIGS. 5A-5E and FIG. 6, the front surface of the rear wall of the magazine well (as indicated by alignment line 510) can be placed in alignment with or behind the front surface of the trigger assembly. This alignment may allow the rear surface of the magazine to contact the front wall of the magazine 105 when the magazine is inserted into the magazine well 214. In some embodiments, the magazine 105 may not contact the trigger assembly, but may be placed closer to the trigger assembly in than provided by other bottom metal components.

As also shown, the alignment of the magazine well sidewalls 508 may also allow the rear surface of the magazine to be aligned with, and in some embodiments engage, the front surface of the trigger guard 212 and/or the magazine release 502. When the bottom metal 210 is configured to allow the magazine 105 to contact the trigger assembly 206 and/or the trigger guard 212, the magazine 105 may be stabilized within the magazine well 214. This alignment may also provide the longest or near longest OAL available for a given opening in the lower side of the receiver 204.

Figure 7A:
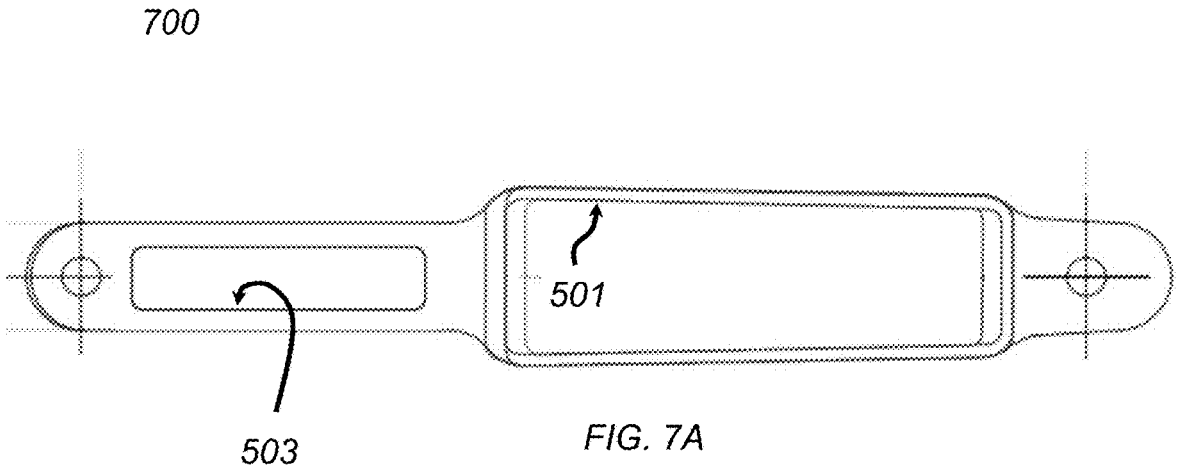
FIGS. 7A-7B illustrate various views of a bottom metal according to embodiments of the disclosure.
Figure 7B:
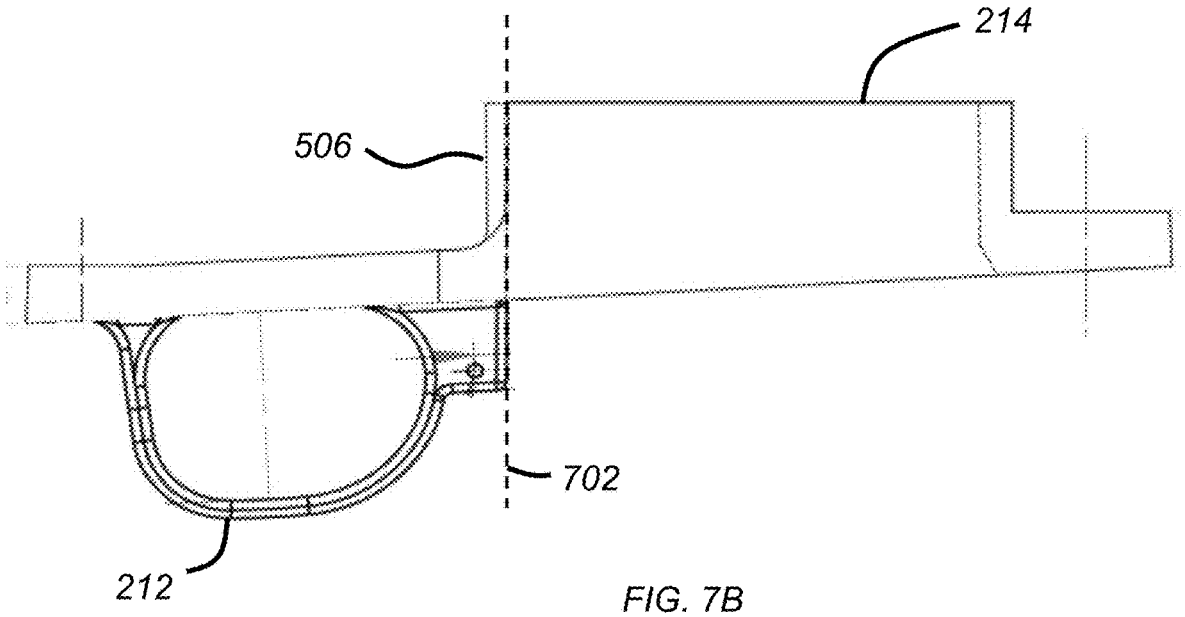

FIGS. 7A-7B illustrate various additional views of another bottom metal 700 according to some embodiments. The bottom metal 700 is similar to the bottom metal described with respect to FIGS. 5A-6, and as such, the same or similar components are labeled with the same reference signs. As shown, the bottom metal 700 comprises a trigger guard 212 disposed below a trigger opening 503 and a magazine well 214 as described above. The bottom metal 700 also comprises a magazine well 214 having a plurality of sidewalls 506 extending upwards towards the receiver. The upwards extending sidewalls 506 surround and define the magazine well opening 501 that is configured to receive the magazine 105. The interior surface of the magazine well 214 serves to engage and support the magazine while it is inserted and retained in position within the rifle. The magazine well sidewalls 506 can comprise a straight or sloped upper edge. As shown in FIG. 7B, the upper edge of the magazine well sidewalls 506 can be sloped from front to back, though when placed in a given rifle, a sloped edge may assume a level configuration due to a sloped configuration of the bottom metal relative to the stock and the remaining components of the action. As shown in FIG. 7B, the sidewalls can be straight and form a relatively uniform magazine well 214.

In this embodiment, the interior, rear surface of the magazine well 214 can be aligned with, or near, a front surface of the trigger guard 212 (as shown by alignment line 702 in FIG. 7B). In this alignment, a rear surface of the rear wall of the magazine well 214 may engage the front surface of the trigger assembly. This alignment may allow the side walls 506 and/or the magazine to engage the trigger assembly and/or the trigger guard 212, thereby stabilizing the magazine during use. In some embodiments, the use of the bottom metal described herein can be used with a factory stock, while in other embodiments, the opening in the stock may need to be customized in order to receive the new bottom metal with the unique alignments.

EXAMPLES

A SAKO TRG 42 Magazine Compatible one piece bottom metal for a Tikka T3 or T3x bolt action rifles can be made from aircraft grad aluminum with a magazine well for aftermarket detachable box magazines and a spring actuated retaining lever that is recessed more posteriorly towards the trigger guard to hold magazine in position via predefined detent in magazine. The repositioned magazine well allows longer OAL ammunition to feed into the bottom of the rifle's receiver without being obstructed by the feed port on the bottom of the action. This design is unique in that there are no existing bottom metal components that are compatible with TRG 42 magazines and in that it allows a longer cartridge OAL than factory or existing bottom metal for AI magazines.

As a second example, an Accuracy International (AI) Magazine Compatible one piece bottom metal for Tikka T3 or T3x bolt action rifles is considered. The design is similar to that in the first example, but is utilized for the more common aftermarket Accuracy International magazine (AI). This design is unique from a factory bottom metal in that it repositions the magazine release lever from the front of the bottom metal (front side of magazine well) to the rear end of the magazine well near the trigger guard and allows for a substantially longer cartridge OAL. This design is also unique from other AI-compatible aftermarket bottom metals that have a rear magazine release lever in that it moves the magazine well rearward as in the first example to allow a longer cartridge OAL. This design can also be compatible with both aftermarket stocks as well as the Factory/OEM stock. Current aftermarket bottom metal for use with Factory stocks is limited to use with factory magazine.

Having described various rifles, bottom metal components, devices, and methods, specific embodiments can include, but are not limited to:

In a first embodiment, a rifle comprises: a receiver; a trigger assembly operably coupled to the receiver; and a bottom metal coupled to the receiver, wherein the bottom metal comprises a magazine well comprising a magazine well sidewall, wherein a front surface of a rear portion of the magazine well sidewall is aligned at or near a front surface of the trigger assembly.

A second embodiment can include the rifle of the first embodiment, wherein the rear portion of the magazine well sidewall is disposed below the trigger assembly.

A third embodiment can include the rifle of the first or second embodiment, wherein the front surface of the rear portion of the magazine well sidewall is aligned with or behind the front surface of the trigger assembly.

A fourth embodiment can include the rifle of any one of the first to third embodiments, further comprising: a magazine disposed within the magazine well.

A fifth embodiment can include the rifle of the fourth embodiment, wherein the magazine engages the magazine well sidewall and the front surface of the trigger assembly.

A sixth embodiment can include the rifle of the fourth embodiment, wherein the bottom metal comprises a trigger guard, and wherein a rear surface of the magazine engages a front surface of the trigger guard.

A seventh embodiment can include the rifle of any one of the first to sixth embodiments, wherein the magazine well sidewall comprises a cutout at the rear end, wherein the cutout is disposed below the trigger assembly.

An eighth embodiment can include the rifle of any one of the fourth to seventh embodiments, further comprising a trigger coupled to the trigger assembly, wherein the trigger passes through a trigger opening in the bottom metal and is surrounded by a trigger guard coupled to the bottom metal.

A ninth embodiment can include the rifle of the eighth embodiment, further comprising: a magazine release coupled to a front surface of the trigger guard, wherein the magazine release is configured to retain the magazine in the magazine well.

In a tenth embodiment, a bottom metal component comprises: a bottom metal base comprising a trigger opening and a magazine well opening; a trigger guard extending in a first direction from the bottom metal base, wherein the trigger opening is disposed above the trigger guard; and a magazine well sidewall extending in a second direction from the bottom metal base, wherein the magazine well opening is disposed below the magazine well sidewall, wherein the magazine well sidewall is configured to be disposed below a trigger assembly when assembled in a rifle.

An eleventh embodiment can include the bottom metal component of the tenth embodiment, wherein the magazine well sidewall comprises a cutout at a rear end, wherein the cutout is configured to allow the magazine well sidewall to be disposed below the trigger assembly when assembled in the rifle.

A twelfth embodiment can include the bottom metal component of the tenth or eleventh embodiment, further comprising a magazine release coupled to the trigger guard.

A thirteenth embodiment can include the bottom metal component of the twelfth embodiment, wherein the magazine release is biased by a spring in a configuration to retain a magazine in the magazine well sidewall.

A fourteenth embodiment can include the bottom metal component of the twelfth or thirteenth embodiment, further comprising a magazine disposed in the magazine well opening, wherein the magazine engages the trigger guard and the magazine release when the magazine is disposed in the magazine well opening.

A fifteenth embodiment can include the bottom metal component of any one of the tenth to thirteenth embodiments, further comprising a magazine disposed in the magazine well opening, wherein the magazine engages the trigger guard when the magazine is disposed in the magazine well opening.

In a sixteenth embodiment, a bottom metal component comprises: a bottom metal base comprising a trigger opening and a magazine well opening; a trigger guard extending in a first direction from the bottom metal base, wherein the trigger opening is disposed above the trigger guard; and a magazine well sidewall extending in a second direction from the bottom metal base, wherein the magazine well opening is disposed below the magazine well sidewall, wherein an interior surface of a rear magazine side wall is aligned with at least a portion of the trigger guard.

A seventeenth embodiment can include the bottom metal component of the sixteenth embodiment, wherein the magazine well sidewall is configured to engaged a trigger assembly when assembled in a rifle.

An eighteenth embodiment can include the bottom metal component of the sixteenth or seventeenth embodiment, wherein the trigger guard comprises a magazine release, wherein the interior surface of the rear magazine side wall is aligned with a front surface of the magazine release.

A nineteenth embodiment can include the bottom metal component of the sixteenth or seventeenth embodiment, further comprising a magazine disposed in the magazine well opening, wherein the magazine engages at least a portion of the trigger guard when the magazine is disposed in the magazine well opening.

A twentieth embodiment can include the bottom metal component of the nineteenth embodiment, wherein the magazine engages a rear magazine well sidewall, and wherein the rear magazine sidewall engages a front surface of a trigger assembly when assembled in a rifle.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A rifle comprising:

a receiver;

a trigger assembly operably coupled to the receiver; and a bottom metal coupled to the receiver, wherein the bottom metal comprises a magazine well comprising a magazine well sidewall, wherein an interior front surface of a rear wall of the magazine well sidewall is vertically aligned with a front surface of the trigger assembly, wherein the magazine well sidewall comprises a cutout at the rear wall, wherein the cutout is disposed below the trigger assembly.

2. The rifle of claim 1, wherein the rear portion of the magazine well sidewall is disposed below the trigger assembly.

3. The rifle of claim 1, wherein the front surface of the rear portion of the magazine well sidewall is aligned with or behind the front surface of the trigger assembly.

4. The rifle of claim 1, further comprising: a magazine disposed within the magazine well.

5. The rifle of claim 4, wherein the magazine engages the magazine well sidewall and the front surface of the trigger assembly.

6. The rifle of claim 4, wherein the bottom metal comprises a trigger guard, and wherein a rear surface of the magazine engages a front surface of the trigger guard.

7. The rifle of claim 4, further comprising a trigger coupled to the trigger assembly, wherein the trigger passes through a trigger opening in the bottom metal and is surrounded by a trigger guard coupled to the bottom metal.

8. The rifle of claim 7, further comprising: a magazine release coupled to a front surface of the trigger guard, wherein the magazine release is configured to retain the magazine in the magazine well.

9. A bottom metal component comprising:

a bottom metal base comprising a trigger opening and a magazine well opening;

a trigger guard extending in a first direction from the bottom metal base, wherein the trigger opening is disposed above the trigger guard; and a magazine well sidewall extending in a second direction from the bottom metal base, wherein the magazine well opening is disposed below the magazine well sidewall, wherein the magazine well sidewall comprises a cutout at the rear wall, wherein the cutout is configured to be disposed below the trigger assembly when assembled in the rifle.

10. The bottom metal component of claim 9, further comprising a magazine release coupled to the trigger guard.

11. The bottom metal component of claim 10, wherein the magazine release is biased by a spring in a configuration to retain a magazine in the magazine well sidewall.

12. The bottom metal component of claim 10, further comprising a magazine disposed in the magazine well opening, wherein the magazine engages the trigger guard and the magazine release when the magazine is disposed in the magazine well opening.

13. The bottom metal component of claim 9, further comprising a magazine disposed in the magazine well opening, wherein the magazine engages the trigger guard when the magazine is disposed in the magazine well opening.

* * * * *